United States Patent [19]

Cordes et al.

[11] Patent Number: 4,709,588

[45] **Date of Patent: * Dec. 1, 1987**

[54] OPERATING ARM FOR AN EARTH-MOVING AND FOUNDATION MACHINE

[76] Inventors: Hugo Cordes, No. 7, Rulantweg, 2000 Hamburg 50; Hans Kröger, No. 184c, Stockfleetweg, 2000 Hamburg 62, both of Fed. Rep. of Germany

[ * ] Notice: The portion of the term of this patent subsequent to Nov. 1, 2003 has been disclaimed.

[21] Appl. No.: 483,320

[22] Filed: Apr. 8, 1983

[51] Int. Cl.[4] ..... B25J 9/06; F16H 21/04; G05G 11/00

[52] U.S. Cl. ..... 74/103; 74/479; 248/281.1; 414/917

[58] Field of Search ..... 74/103, 479; 414/733, 414/917; 248/281.1

[56] References Cited

U.S. PATENT DOCUMENTS 521,256 6/1894 Browne ..... 414/917 X
717,121 12/1902 Richardson ..... 248/281.1
2,656,058 10/1953 Foote ..... 414/917 X
2,900,830 8/1959 Eisenburger et al. ..... 74/103
3,094,228 4/1960 Peterson ..... 414/917 X
4,234,150 11/1980 Mee et al. ..... 248/281.1

FOREIGN PATENT DOCUMENTS 1069974 11/1959 Fed. Rep. of Germany ..... 74/103
3106268 9/1982 Fed. Rep. of Germany .

*Primary Examiner*—Allan D. Herrmann

[57] ABSTRACT

An operating arm for earth-moving or foundation machines consisting of an upper and a lower arm pivotally connected via a device for equal angular movement for guidance of various tools on a straight-line force path of great length. The direction of this path is variable by means of a force control basic guide lever. If said basic lever is turned during the straight-line movement, superimposing the two movements cause curving of the forced path. If rapid return is provided, excavation may be performed in either one or the other direction and a drilling or ramming tool may be raised or lowered with higher force. Rotation into a load carrying position is provided for excavator buckets.

10 Claims, 12 Drawing Figures

Fig. 1
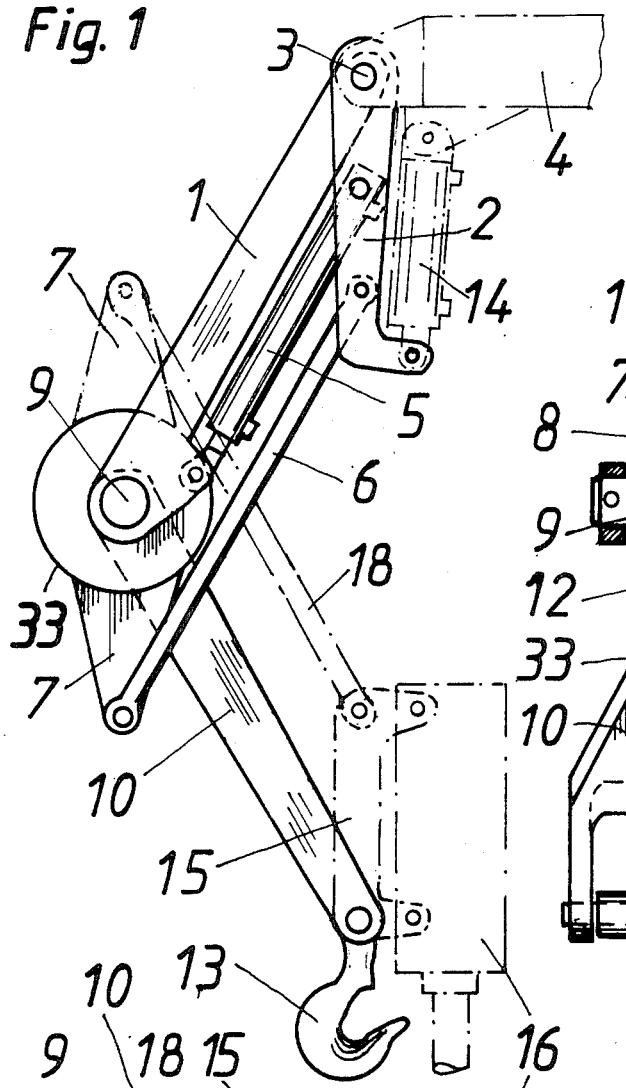
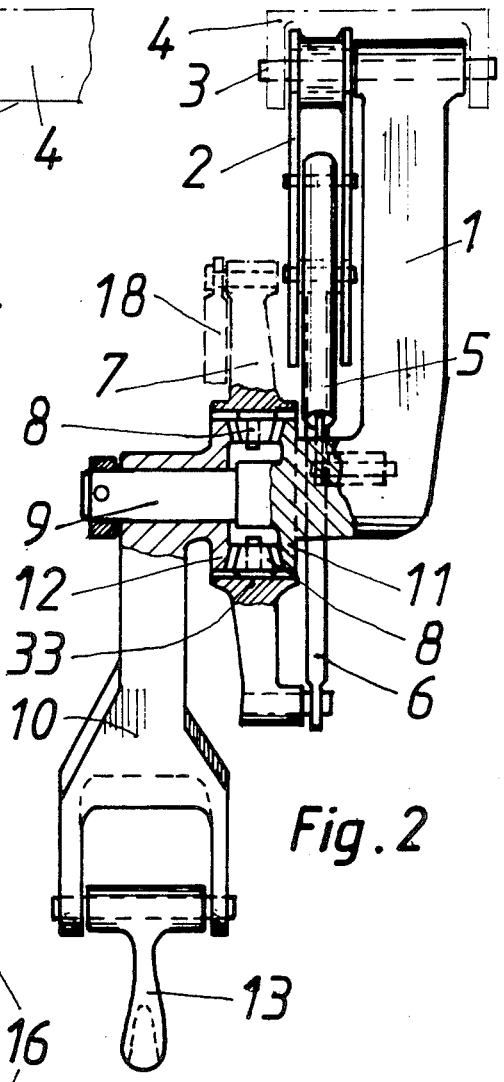
Fig. 2
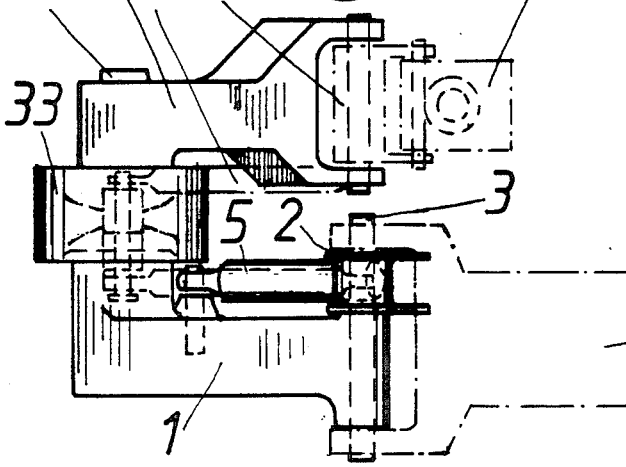
Fig. 3

30
31
10
33
9
28,29
7
6
5
26
3
1
2
4
14
32
28
29
27

OPERATING ARM FOR AN EARTH-MOVING AND FOUNDATION MACHINE

BACKGROUND OF THE INVENTION

This invention relates to an operating arm attached to an earth-moving or foundation machine and guiding different tools, which consists of an upper arm pivotally connected directly to the machine or via a boom, a lower arm pivotally connected to the upper arm and carrying the tool, and with a drive which moves the upper arm and the lower arm from an extended position via a folded position, in which both arms are side by side, into an oppositely extended position.

An operating arm of this type with an excavator bucket is known from German Offenlegungsschrift No. 3,106,268 of the applicant. By means of a multi-element linkage pivotally connected to the boom and connected to the upper arm, the operating arm guides the excavator bucket on a curved forced path to the dumping spot and back along the same path to the excavation area. A disadvantage with this arrangement is that the direction of the forced path can only be changed by rotating the boom up or down and that the curvature of the forced path is determined by the linkage and unalterable. In addition, no exactly straight-line path can be achieved by means of the linkage. These disadvantages hinder multi purpose applications.

SUMMARY OF THE INVENTION

It is the object of the present invention to so improve the known operating arm that it cannot only guide an excavator bucket, but may be used for other tools too and makes possible a straight-line forced path of selectable direction and length of movement, which can also be curved for parts of the path or over the complete length. In case of rapid return movement, the working stroke and return should be exchangeable. It should be possible to guide the tool in a position remaining constant relative to the forced path. With excavator buckets, rotation into a load carrying position should be possible.

To attain this object, the present invention provides an operating arm comprising an upper arm pivotally connected by a pivot pin to the machine directly or via a boom; a lower arm pivotally connected to the upper arm and carrying the tool; a drive which moves the upper arm and the lower arm from an extended position via a folded position, in which both arms are side by side, into an oppositely extended position; a base guide pivotable about the pivot pin of the upper arm by means of a directive cylinder supported on the boom; an upper arm cylinder driving the upper arm and a connecting rod parallel to and of the same length as the upper arm which are both pivotally connected to the base guide; a parallel guide which is pivotally supported on the joint between the upper arm and the lower arm and is guided by the connecting rod parallel to the base guide, a device for equal angular movement which is connected to the parallel guide and by means of which the lower arm and the upper arm execute opposite angular deflections of equal magnitude relative to the parallel guide.

The present invention offers the following advantages:

With the same length of upper and lower arm—from joint to joint—various types of tools are guided on a straight-line forced path the direction of which can be altered by a base guide and which path is almost twice as long as the length of the upper and lower arms taken together. Driving force and velocity remain practically unaltered all over the complete length with appropriate arrangement of the hydraulic drive, which is effected preferably by means of an upper arm cylinder. The working stroke can be shortened by any amount at both path ends.

By superimposing a rotation of the base guide simultaneously with the straight-line movement, the forced path can be curved over its whole length or parts of it in one or the other direction. This makes possible profile excavation and enables adaptation to many practical tasks. With the basic arrangement, this operating arm is suitable for moving load hooks, grabs and similar tools to be moved on a straight line up and down as well as horizontally.

With tool guidance means added, other tools may be attached which need not only guiding on a straight line path but holding their axes on the direction of movement as well, such as drills, ramming and drawing tools, vibrators and similar equipment. Said means keep the digging edge of excavator buckets or dozer blades in a constant position relative to the digging path. During the subsequent movement to the emptying spot means may be necessary to rotate the bucket into a load carrying position so that the bucket contents will not drop.

Changing of rapid return from one into the other direction of longitudinal movement can be attained by changing the pivotal connections of the upper arm cylinder. By this means, drills, hammers or drawing tools may either work with high lifting or with high lowering force. In addition an excavator bucket or a dozer blade must be turned around to dig on its path away from the machine like a loading shovel. Slopes extending above or below the driveway can be cut or levelled in both operating directions.

Due to the exactly and repeatably maintained forced path, this operating arm is extremely suitable for precision work in excavating, earth-leveling and profiling, in removing and applying layers, in trimming and packing slopes, cleaning ditches and similar tasks.

BRIEF DESCRIPTION OF THE DRAWINGS

Illustrative embodiments of the invention will now be described by way of example and with reference to the accompanying schematic drawings, in which:

FIG. 1 shows an operating arm beginning to lift a load hook and the device for equal angular movement embodied as a bevel gear reversing mechanism; and, in dash-and-dot lines, a tool guiding device with a drilling or ramming tool;

FIG. 2 is a side view, partially in section, of FIG. 1;

FIG. 3 is a plan view of FIG. 1;

DESCRIPTION OF THE PREFERRED EMBODIMENTS

Figure 4:
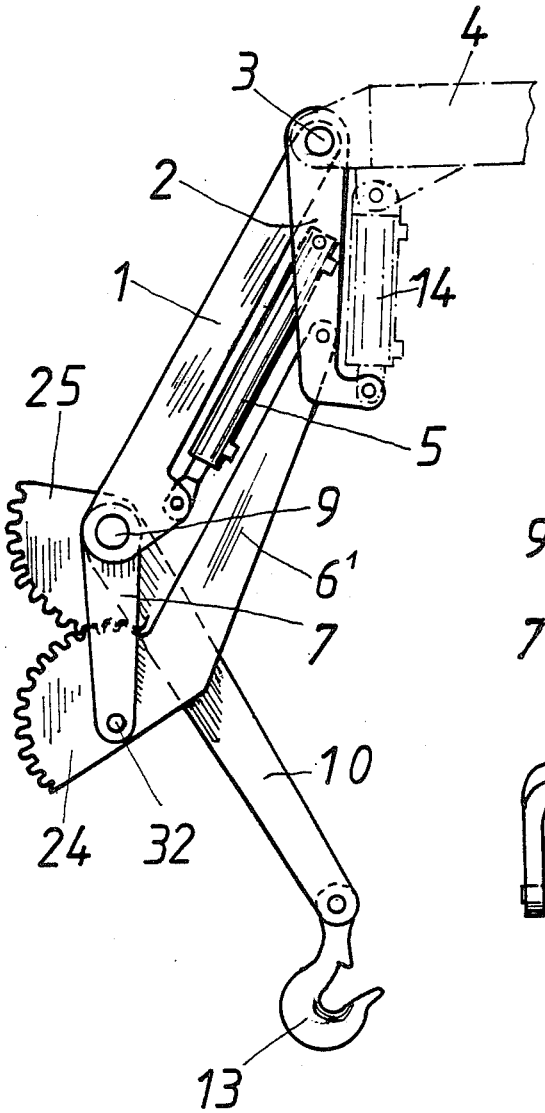
FIG. 4 shows an embodiment of an operating arm using spur gear segments acting as device for equal angular movement.

FIGS. 1 to 3 show an upper arm 1 and a base guide 2 which are supported on a carrier vehicle or its boom 4 by means of a pivot pin 3 and can be pivoted under the control of a directive cylinder 14. An upper arm cylinder 5, which operates the upper arm 1, and a connecting rod 6 are pivotally connected to the base guide 2. The connecting rod has the same length as the upper arm 1 and is arranged parallel to it and guides a parallel guide 7 parallel to the base guide 2. At the joint pin 9 between the upper arm 1 and the lower arm 10, a device for equal angular movement is arranged, which drives the lower arm 10.

In FIGS. 1 to 3, the device for equal angular movement is embodied as a reversing mechanism, the casing 33 of which carries bevel pinions 8 and is solidly connected to the parallel guide 7. Said bevel pinions 8 are in engagement with a driving bevel gear 11, which is solidly connected to the upper arm 1, and with a driven bevel gear 12, which is solidly connected to the lower arm 10. While the upper arm 1 rotates relative to the reversing casing 33, said driving and driven bevel gears 11 and 12 cause that the lower arm 10 executes the same angular movement relative to the reversing casing 33 but in the opposite direction. If the upper arm 1 and the lower arm 10 have the same length, the free end of the lower arm 10 moves on an exactly straight-line path. Since the upper arm 1 and the lower arm 10 lie in different planes, they can be moved from an extended position through an intermediate position, in which they are side by side into an opposite extended position, the free end of the lower arm 10 moving with a stroke, which has nearly double length of both arms taken together.

The upper arm cylinder 5 acts upon the upper arm 1 with equal, but short lever arm at the beginning and end of the stroke and with a longer lever arm in the intermediate position. This results in a approximately constant lifting force and speed during the complete forced path of the load hook 13 or a tool 16.

As shown in dash-and-dot lines in FIGS. 1 and 3, a tool guide 15 may be pivotally connected to the free end of the lower arm 10 and guided in parallel by a rod 18 which is pivotally connected to the parallel guide 7 and has the same length as and is parallel to the lower arm 10. Tool guide 15 may be connected to a tool 16 whose longitudinal axis remains in the direction of movement over a long path. This makes the operating arm extremely suitable for guiding earth-leveling, drilling, ramming and pile extracting equipment and for maintaining the pos;:tion of the cutting edge of excavating tools. Said tool guide 15 may be combined with different devices for equal angular movement.

Figure 5:
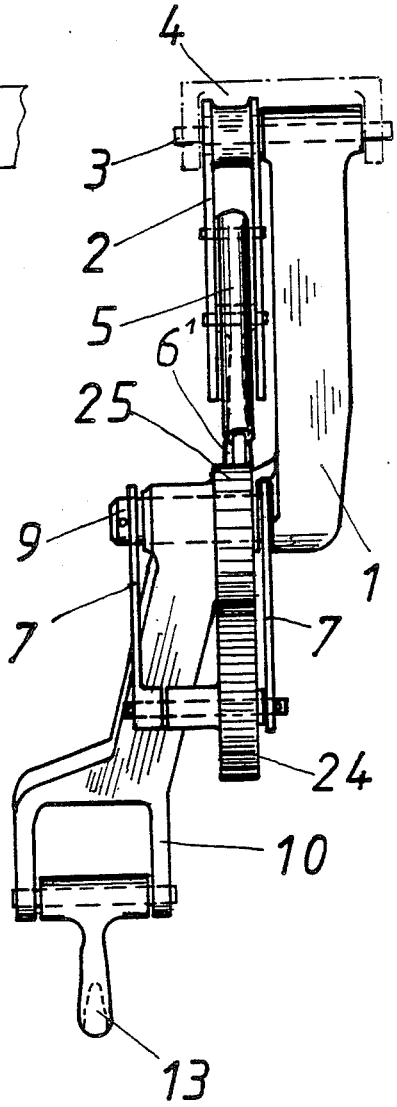
FIG. 5 is a side view of FIG. 4.

In FIGS. 4 and 5, said device is made up of a spur gear segment 24 attached to a connecting rod $6^1$ being reinforced against bending stresses and a spur gear segment 25 of the same size solidly attached to the lower arm 10, the spur gear segments 24 and 25 being in constant mesh. If the connecting rod $6^1$ and the parallel guide 7 are located on the other side of the upper arm 1, the spur gear segments 24 and 25 are turned round correspondingly.

Figure 6:
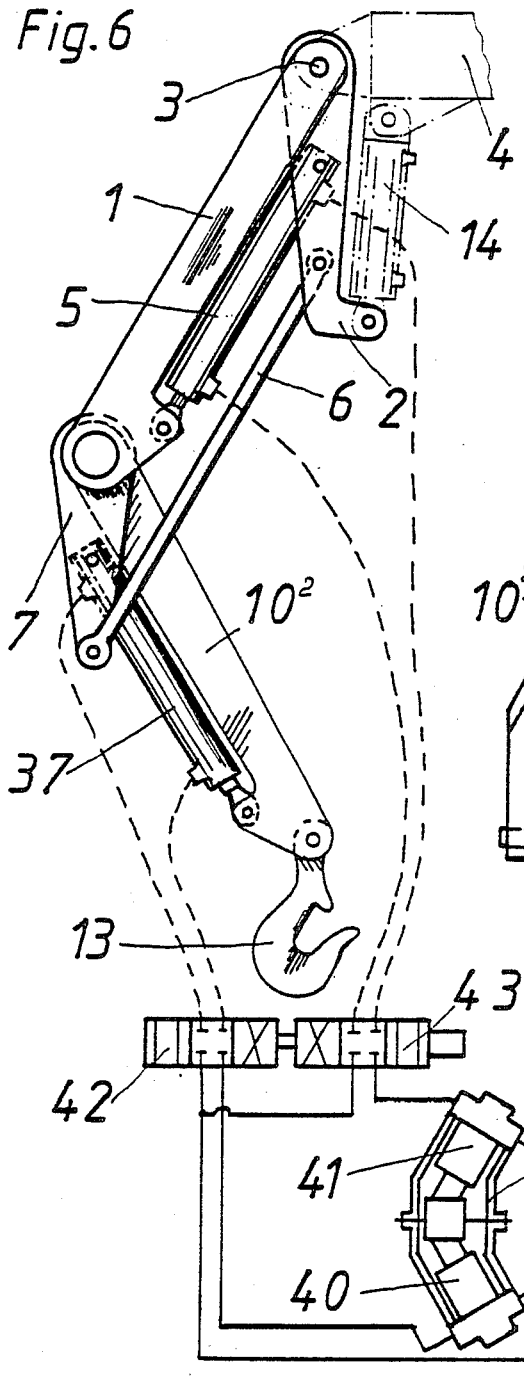
FIG. 6 shows an embodiment of an operating arm with an additional lower arm cylinder and a flow divider acting as device for equal angular movement.
Figure 7:
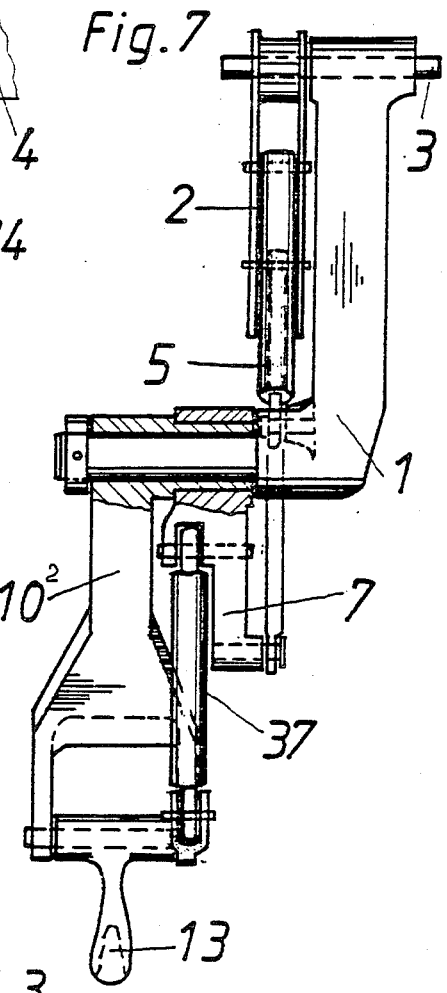
FIG. 7 is a side view of FIG. 6.

FIGS. 6 and 7 show a hydraulic device for equal angular movement. A lower arm $10^2$ is driven by a lower arm cylinder 37 which is supported on the parallel guide 7 and whose piston rod is pivotally connected to the lower arm $10^2$. The upper arm cylinder 5 and the lower arm cylinder 37 may be supplied separately from two hydraulic pumps, or each from one hydraulic pump 39 operating via a flow divider 38. The flow divider shown consists of a fixed hydraulic motor 40 and a variable hydraulic motor 41, whose shafts are connected to each other so that differing cylinder pressures are balanced out. Direction valves 42 and 43 are installed in the supply and return lines.

Figures 8, 9, 10:
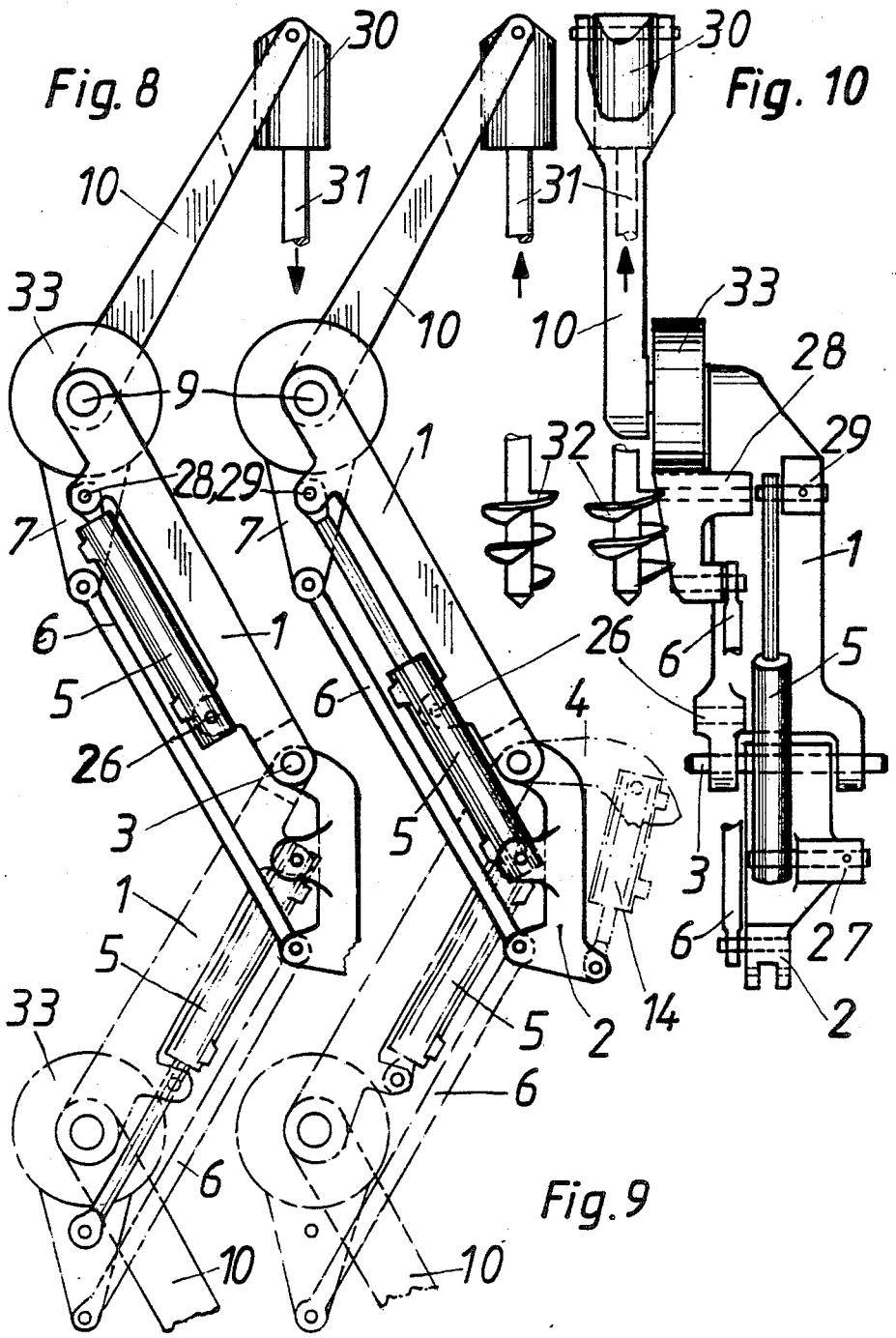
FIG. 8 snows an operating arm similar to FIG. 1, in the top and bottom positions, equipped with additional pivot bearings for the upper arm cylinder to change the working direction and with an earth drill in the position for high penetration force.
FIG. 9 shows an operating arm in accordance with FIG. 8, equipped for high lifting force.
FIG. 10 is a side view of FIG. 9.

FIGS. 8 to 10 show how lifting and lowering force may be exchanged for either high force raising or high force lowering. A drilling unit is shown consisting of a drill motor 30, a drill rod 31 and an earth drill bit 32. The device for equal angular movement is indicated according to FIGS. 1 and 2.

In FIGS. 9 and 10 just as shown in FIGS. 1 and 2, the upper arm cylinder 5 is pivotally connected to a pivot bearing 27 of the base guide 2 and its piston rod to a pivot bearing 29 of the upper arm 1, resulting in high lifting force.

In FIG. 8, however, the upper arm cylinder 5 is pivotally connected to an additional pivot bearing 26 of the upper arm 1 and its piston rod to an additional pivot bearing 28 of the parallel guide 7 giving (high lowering force).

The relocation is easy to carry out, because the pivot bearings 26 and 27 for the upper arm cylinder 5 are aligned at the lower end of the stroke, so that the location pin can be pushed across. The piston rod must then be driven in or out; until its pivot bearings 28 and 29 align at the upper end of the stroke.

Figure 11:
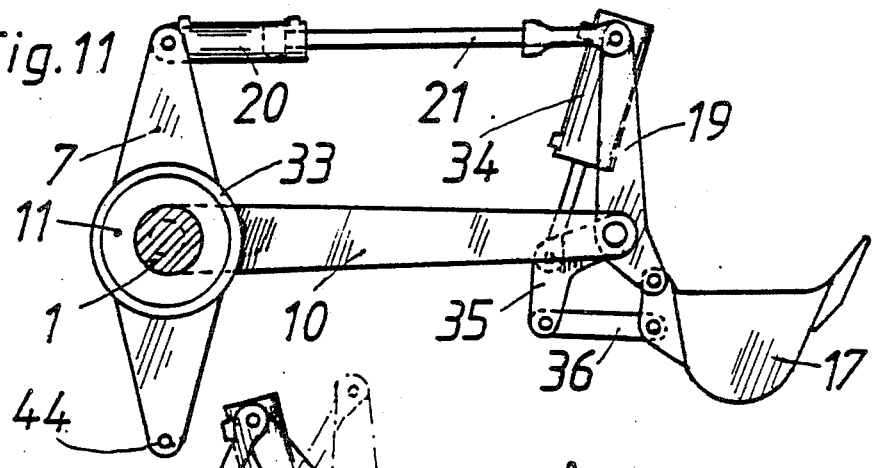
FIG. 11 shows the lower arm with an excavator bucket which can be rotated into a load carrying position by means of shortening the connecting rod and FIG. 12 shows the lower arm with an excavator bucket similar to FIG. 11 with the connecting rod, being connected to a lever in three positions.
Figure 12:
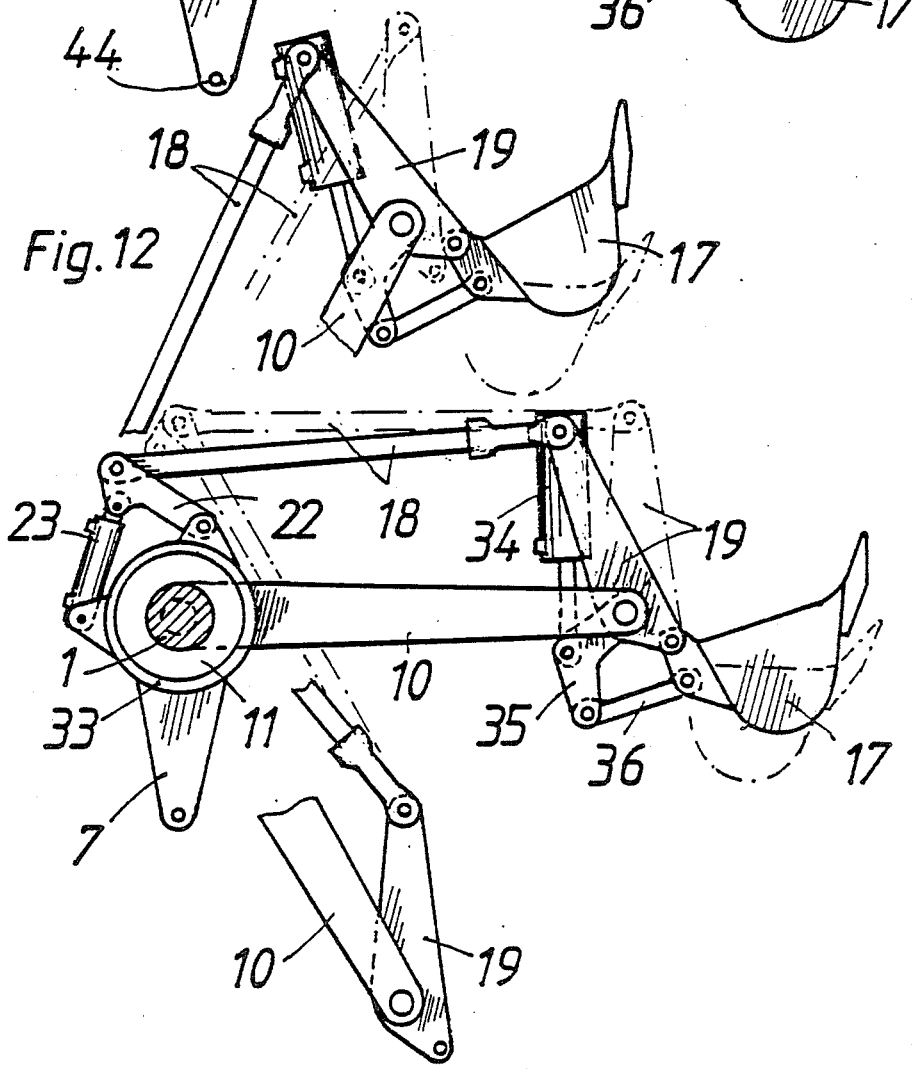

A tool like an excavator bucket 17 or a dozer blade to be adapted with connecting rod 18 according to FIGS. 11 and 12 must be installed in the reverse direction in case of exchanging the direction of working stroke and return. For this purpose, the connecting rod 18 (FIG. 1) or the hydraulic cylinder 20 with piston rod 21 (FIG. 11) will be pivotally connected to a pivot bearing 44, i.e. at the other end of the parallel guide 7. The bucket guide 19 with the bucket 17 and its drive assembly comprising a bucket cylinder 34, a lever 35 and a rod 36 will be turned by 180°.

In FIGS. 11 and 12, only the lower arm 10 and the parallel guide 7 with the reversing casing 33 are shown in accordance with FIG. 1 but in a mid-stroke position. A bucket guide 19 with an excavator bucket 17 is shown instead of the tool guide 15, the excavator bucket being pivotable by means of a bucket cylinder 34 via the lever 35 and the rod 36 from the excavating position into an emptying position.

In order to prevent dropping of load from the excavator bucket 17 during a horizontal forced path to the emptying spot, the connecting rod 18 (from FIG. 1) is replaced, as in FIG. 11, by a hydraulic cylinder 20 with a lengthened piston rod 21 in extended position. If the piston rod 21 is retracted the excavator bucket 17 is turned into a load carrying position.

FIG. 12 shows another embodiment in three phases. The connecting rod 18 is pivotally connected to an adjustment lever 22, which is pivot-mounted to the parallel guide 7 and rotated by an adjustment cylinder 23. If its piston rod is retracted at the beginning of the stroke the bucket 17 still remains in its parallel position. During the stroke, the bucket 17 is increasingly rotated into a load carrying position.

Said two load carrying devices may be initiated or stopped at any desired point by controlling the hydraulic cylinder 20 or the adjustment cylinder 23.

The directive cylinder 14 pivotally attached to the carrier vehicle or its boom 4 determines the direction of the forced path by rotating the base guide 2. The base guide may extend in the direction towards the carrier vehicle, as shown in FIG. 3, or in the opposite direction, as not shown. If the piston rod of the directive cylinder 14 (FIGS. 1, 4, 6 and 9) is moved in or out during the longitudinal stroke, the straight-line movement and the rotation of the base guide 2 about the pivot pin 3 are superimposed and the two movements provide a curved forced path for all tools 13, 16, 17 or 30.

The invention may be embodied in other specific forms without departing from the spirit or essential characteristics thereof. The embodiments are therefore to be considered in all respects as illustrative and not restrictive.

What is claimed is:

1. An operating arm to be adapted to an earth-moving or foundation machine for the guidance of a tool, comprising (a) an upper arm (1) pivotally connected by a pivot pin (3) either directly to the machine or via a boom (4);

(b) a lower arm (10) pivotally connected to the upper arm and carrying the tool;

(c) a drive which moves the upper arm and the lower arm from an extended position via a folded position, in which both arms are side by side, into an oppositely extended position;

(d) a base guide (2) which is supported on the pivot pin (3) of the upper arm (1) and revolving about said pin by means of a directive cylinder (14) supported on the boom (4);

(e) an upper arm cylinder (5) driving the upper arm (1) and a connecting rod (6) being parallel to and of the same length as the upper arm, which are both pivotally connected to the base guide (2);

(f) a parallel guide (7) which is pivotally supported on the joint (9) between said upper arm and lower arm and is guided by the connecting rod (6) parallel to said base guide, and (g) a device for equal angular movement which is connected to the parallel guide (7) and by means of which the lower arm (10) and the upper arm (1) execute equivalent but opposite angular deflections relative to the parallel guide.

2. An operating arm according to claim 1, wherein the device for equal angular movement is embodied as a reversal mechanism, in particular as a bevel gear reversal mechanism the casing (33) of which is located on the joint between the lower arm (10) and the upper arm (1) and which is solidly connected to the parallel guide (7) and supports bevel pinions (8) which are in engagement with a driving bevel gear (11), which is solidly connected to the upper arm (1), and with a driven bevel gear (12), which is solidly connected to the lower arm (10).

3. An operating arm according to claim 1, wherein the device for equal angular movement consists of mutually engaging equal spur gear segments (24, 25) supported on the parallel guide (7) one spur gear segment (24) being solidly connected to the connecting rod (6) which is reinforced for bending stresses, and the other spur gear segment (25) being solidly connected with the lower arm (10).

4. An operating arm according to claim 1, wherein the device for equal angular movement consists of a lower arm cylinder (37) pivotally connected to the parallel guide (7) with a piston rod pivotally connected to the lower arm (10), and of a flow divider (38), which divides the high pressure oil flow from a hydraulic pump (39) between the upper arm cylinder (5) and the lower arm cylinder (37).

5. An operating arm according to claim 1, wherein a rod (18) is pivotally connected to the parallel guide (7) and parallel to and of the same length as the lower arm (10) and which guides a tool guide (15) parallel to the parallel guide for attaching tools (16).

6. An operating arm according to claim 1, wherein an additional pivot bearing (26) is located on the upper arm (1), which pivot bearing (26) is at one end of the stroke in alignment with the pivot bearing (27) on the base guide (2) and wherein a additional pivot bearing (28) is on the parallel guide (7) which is in alignment at the other end of the stroke with the pivot bearing (29) for the piston rod of the upper arm cylinder (5) and wherein for high lifting force, the upper arm cylinder (5) is fastened to the base guide (2) and its piston rod to the pivot bearing (29) of the upper arm (1) and wherein for high sinking force, the upper arm cylinder (5) is fastened to the pivot bearing (26) of the upper arm (1) and its piston rod to the pivot bearing (28) of the parallel guide (7).

7. An operating arm according to claim 5, wherein the rod (18) can be shortened by being embodied as a hydraulic cylinder (20) with extended piston rod (21) and is shortened by withdrawal of the piston rod and thus rotates the bucket guide (19).

8. An operating arm according to claim 5, wherein the rod (18) is pivotally connected with an adjusting lever (22) which is pivotally connected with the parallel guide (7), and adjustable by an adjusting cylinder (23).

9. An operating arm according to claim 4, wherein the lengths of upper and lower arms (1,10) are unequal and the flow divider (38) consists of a fixed motor (40) and a variable motor (41) and allocates varying oil flow to the lower arm cylinder (37) being different from the flow to the upper arm cylinder (5) along the forced path.

10. An operating arm according to claim 1, with somewhat unequal lengths wherein the device for equal angular movement of the upper and lower arm (1,10) is arranged with somewhat unequal angular deflections of the arms (1,10) relative to the parallel guide (7) for an approximately straight-line forced path.

* * * * *